US006219520B1

(12) United States Patent
Ehara

(10) Patent No.: US 6,219,520 B1
(45) Date of Patent: Apr. 17, 2001

(54) DEVICE FOR COLLECTING AND BLOCKING IMPURITIES FROM APPLICATOR ROLLER IN IMAGE FORMING APPARATUS

(75) Inventor: Masanao Ehara, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/357,280

(22) Filed: Jul. 20, 1999

(30) Foreign Application Priority Data

Jul. 22, 1998 (JP) ..... 10-206498

(51) Int. Cl.[7] ..... G03G 15/20
(52) U.S. Cl. ..... 399/325; 118/60
(58) Field of Search ..... 399/324–326; 118/60, DIG. 1; 432/60; 219/216

(56) References Cited

U.S. PATENT DOCUMENTS 5,142,122 * 8/1992 Ariyama ..... 219/216
5,594,540 * 1/1997 Higaya et al. ..... 399/326
5,666,623 * 9/1997 Yamada et al. ..... 219/216 X
5,678,152 * 10/1997 Kohno et al. ..... 399/324
5,832,354 11/1998 Kouno et al. .
5,915,147 6/1999 Kouno et al. .
5,991,562 * 11/1999 Ito et al. ..... 399/325 X

FOREIGN PATENT DOCUMENTS 8-76628 3/1996 (JP) .
9-6173 1/1997 (JP) .

* cited by examiner

*Primary Examiner*—William J. Royer
(74) *Attorney, Agent, or Firm*—Oblon, Spivak, McClelland, Maier & Neustadt, P.C.

(57) ABSTRACT

A fixing device for an image forming apparatus includes a heat roller and a press roller pressed against the heat roller. An applicator roller applies oil to at least one of the heat roller and press roller. A rotatable cleaning member and a stationary cleaning member are held in contact with the applicator roller.

14 Claims, 5 Drawing Sheets

DEVICE FOR COLLECTING AND BLOCKING IMPURITIES FROM APPLICATOR ROLLER IN IMAGE FORMING APPARATUS

BACKGROUND OF THE INVENTION

The present invention relates to a copier, facsimile apparatus, printer or similar image forming apparatus and more particularly, to a fixing device included therein.

A fixing device of the type including a heat roller and a press roller is customary with an image forming apparatus. The prerequisite with this type of fixing device is that the heat roller and press roller have a high parting ability. A low parting ability would cause part of the toner to adhere to the heat roller or the press roller and would thereby bring about offset. In light of this, there has been proposed a fixing device including a heat roller and a press roller each having a parting layer on its circumferential surface, and an applicator roller for applying silicone oil to the parting layer.

Even the above fixing device using the parting layer and applicator roller scheme cannot fully obviate offset. Specifically, a small amount of offset remains on the heat roller or the press roller and causes toner and paper dust to contaminate the surface of the applicator roller. In addition, the amount of oil to be applied by the applicator roller decreases due to aging, or the surface of the applicator roller is contaminated. The contamination of the applicator roller is retransferred to the heat roller or the press roller, resulting in the contamination of a paper or similar recording medium.

To solve the above retransfer problem, Japanese Patent Laid-Open Publication No. 7-234600, for example, discloses a fixing device including an applicator roller having a unique configuration (Prior Art 1 hereinafter). The applicator roller of Prior Art 1 is made up of a base formed of a foam material and a surface layer formed of the same material as the parting layer of a heat roller or that of a press roller. Specifically, the surface layer is formed of fluorocarbon resin and formed with a number of pores. The base is impregnated with silicone oil. A cleaning member is used to clean the surface of the applicator roller.

Japanese Patent Laid-Open Publication No. 9-6173 teaches a fixing device includes a cleaning roller for cleaning the surface of an applicator roller and a blade for removing impurities from the circumferential surface of the cleaning roller (Prior Art 2 hereinafter).

The problem with Prior Art 1 is that the cleaning roller is contaminated due to aging and, in turn, contaminates the heat roller, as stated earlier. Prior Art 2 has a problem that some paper dust is passed through a gap between the cleaning roller and the blade, also resulting in the contamination of a paper. Today, a filler, for example, is added to papers for promoting recycling or enhancing whiteness. The filler, however, increases the amount of paper dust to be collected by the applicator roller and cleaning roller. Such paper dust causes impurities collected by the cleaning roller to remain on the applicator roller due to the viscosity of toner, lowering the ability of the applicator roller and image quality.

Technologies relating to the present invention are also disclosed in, e.g., Japanese Patent Laid-Open Publication Nos. 8-76628 and 9-6173.

SUMMARY OF THE INVENTION

It is therefore an object of the present invention to provide a fixing device for an image forming apparatus capable of preventing paper dust from remaining on the surface of an applicator roller and thereby insuring the expected ability of the roller.

It is another object of the present invention to provide a fixing device for an image forming apparatus capable of preventing impurities collected by a cleaning roller from being retransferred to a heat roller and thereby insuring high image quality.

A fixing device for an image forming apparatus of the present invention includes a heat roller and a press roller pressed against the heat roller. An applicator roller applies oil to at least one of the heat roller and press roller. A rotatable cleaning member and a stationary cleaning member are held in contact with the applicator roller.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
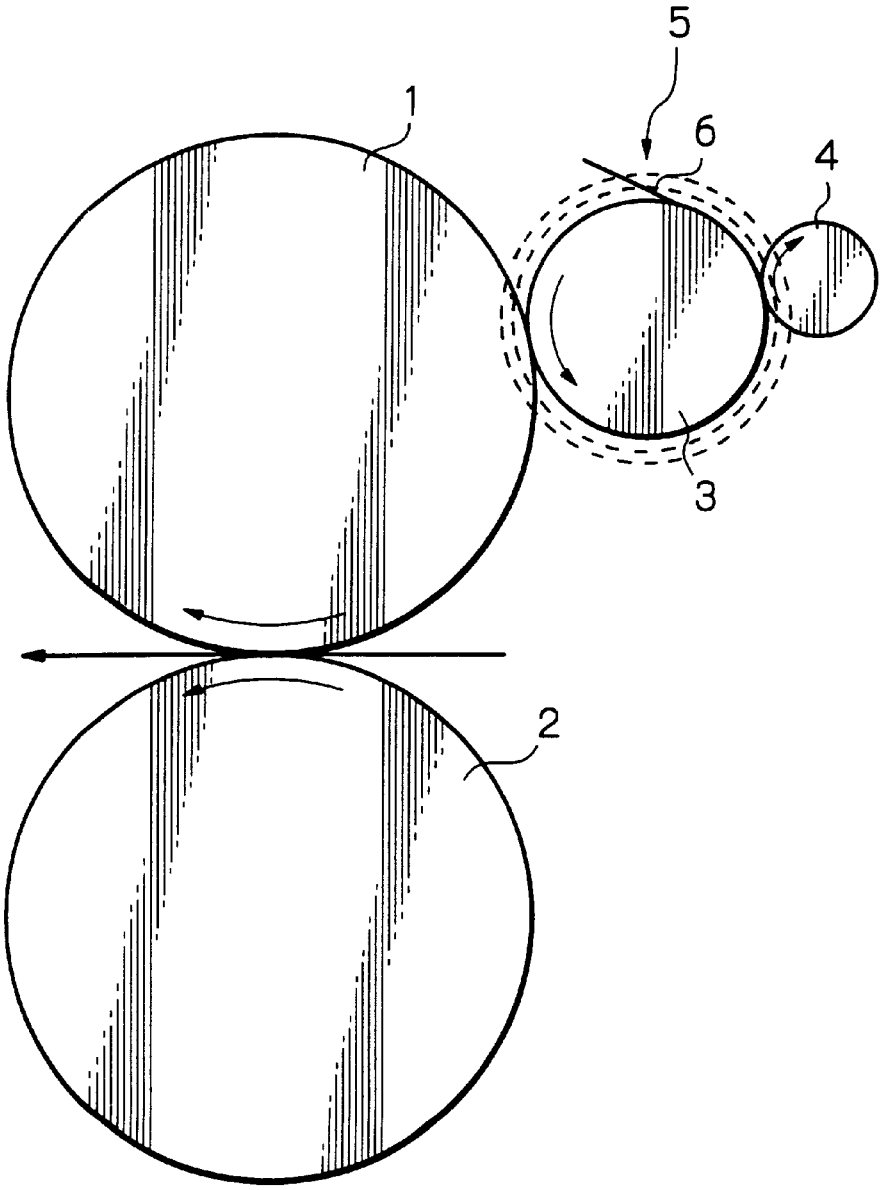
FIG. 1 is a fragmentary front view showing a first embodiment of the fixing device in accordance with the present invention.

Preferred embodiments of the fixing device in accordance with the present invention will be described with reference to the accompanying drawings. In the drawings, identical reference numerals indicate identical structural elements.

Referring to FIG. 1, a first embodiment of the fixing device in accordance with the present invention includes a heat roller 1, a press roller 2 pressed against the heat roller 1, and an applicator roller 3 for applying oil to either one of the rollers 1 and 2. Oil is supplied to the applicator roller 3 from a separate oil supplying member which is in oil supplying contact with the applicator roller as is well known in the art (see, for example, U.S. Pat. No. 5,666,623 to Yamada et al. which shows an oil application device 5 including an oil supply member 52 for supplying oil to a roller 51). A rotatable cleaning member 4 is held in contact with the applicator roller 3. A stationary cleaning member 5 is held in contact with the applicator roller 3. The stationary cleaning member 5 is located upstream of a position where the heat roller 1 and applicator roller 3 contact each other, but downstream of a position where the applicator roller 3 and rotatable cleaning member 4 contact each other. While the applicator roller 3 is shown as contacting only the heat roller 1, it may alternatively contact only the press roller 2. Further, one applicator roller may be assigned to each of the heat roller 1 and press roller 2. This is also true with the other embodiments to be described later.

Figure 2:
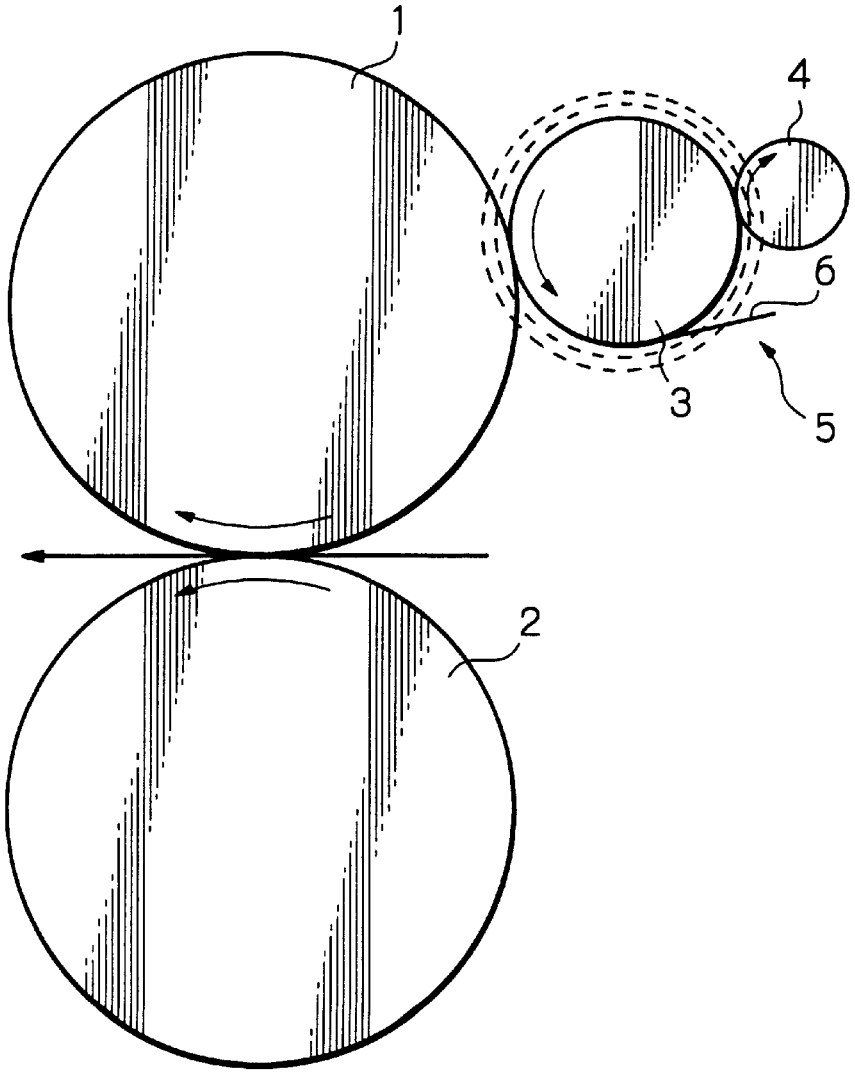
FIG. 2 is a fragmentary front view showing a second embodiment of the fixing device in accordance with the present invention.

The stationary cleaning member 5 is show as a blade 6 in FIGS. 1 and 2. The blade 6 is, e.g., an about 70 μm to 10 μm thick film of polyimide. The blade 6 contacts the applicator roller 3 with a pressure as low as, e.g., about 1 gf/cm to 10 gf/cm.

In the above configuration, assume that impurities deposited on the heat roller 1 due to offset are transferred to the applicator roller 3. Then, the rotatable cleaning member 4 collects most of the impurities from the applicator roller 3. The collection by the rotatable cleaning member 4 becomes more efficient as temperature rises. When the impurities collected by the rotatable cleaning member 4 are retransferred from the rotatable cleaning member 4 to the applicator roller 3, the stationary cleaning member 5 blocks and collects them. Further, even when the oil stays at the portion where the applicator roller 3 and rotatable cleaning member 4 contact each other, the stationary cleaning member 5 regulates and levels the oil.

The above-mentioned impurities include toner and paper dust. Although the rotatable cleaning member 4 cannot easily collect the paper dust, the stationary cleaning member 5, having the previously stated configuration and contacting the applicator roller 3, successfully collects the paper dust. It was experimentally found that the stationary cleaning member 5 should preferably contact the applicator roller 3 with the previously mentioned low pressure.

More specifically, when granular impurities are retransferred from the rotatable cleaning member 4 to the applicator roller 3 due to the elapse of time, the stationary cleaning member 5 blocks and collects them. At this instant, the stationary cleaning member 5, contacting the applicator roller 3 with the low pressure, is capable of selectively blocking paper dust that the cleaning member 4 cannot easily collect. Experiments showed that such a low pressure is desirable for the selective collection of paper dust.

FIG. 2 shows a second embodiment of the present invention identical with the first embodiment except for the following. As shown, the stationary cleaning member 5 is located downstream of the position where the heat roller 1 and applicator roller 3 contact each other, but upstream of the position where the applicator roller 3 and rotatable cleaning member 4 contact each other.

In the second embodiment, when impurities, deposited on the heat roller 1 and including paper dust, are transferred to the applicator roller 3, the stationary cleaning member 5 selectively blocks and collects the paper dust. Subsequently, the rotatable cleaning member 4 efficiently collects toner also included in the impurities. The second embodiment was found to fully obviate the retransfer of impurities from the rotatable cleaning member 4 to the applicator roller 3.

The retransfer of impurities from the rotatable cleaning member 4 to the applicator roller 3 differs from the first embodiment to the second embodiment. This is presumably because adhesion acting between the impurities collected by the cleaning member 4 depends on the ingredients of the impurities.

Figure 3:
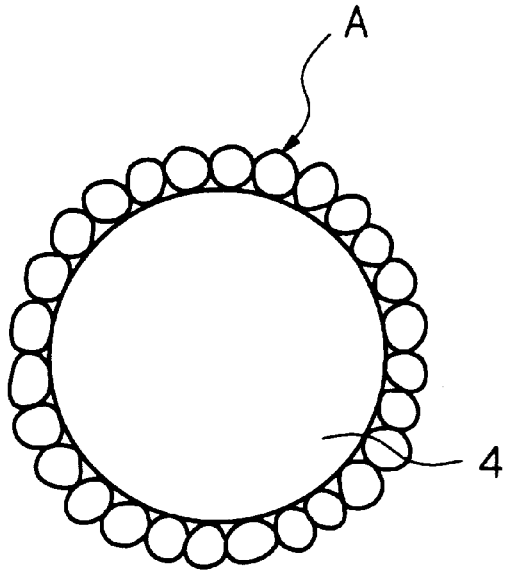
FIG. 3 is a view showing impurities collected by a cleaning member included in the first embodiment.
Figure 4:
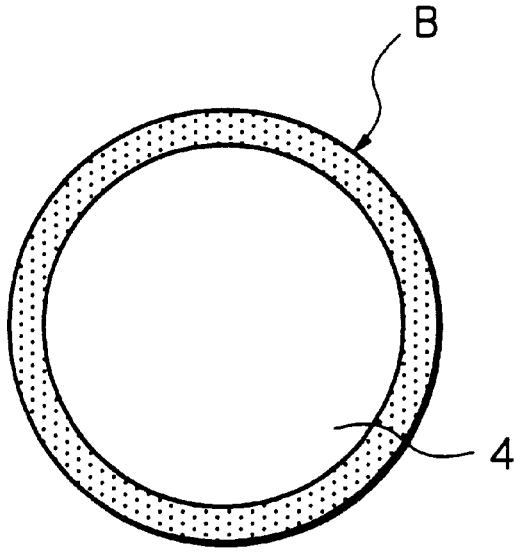
FIG. 4 is a view showing impurities collected by a cleaning member included in the second embodiment.

Specifically, as shown in FIG. 3, the impurities reaching the rotatable cleaning member 4 of the first embodiment include toner and paper dust and are deposited on the cleaning member 4 in the form of particles A forming an irregular surface. There is no adhesion between such particles deposited on the rotatable cleaning member 4, so that the particles easily to come off of the rotatable cleaning member 4 and are retransferred to the applicator roller 3 with the elapse of time. By contrast, as shown in FIG. 4, the impurities reaching the rotatable cleaning member 4 of the second embodiment mainly consist of toner and therefore, uniformly cover the surface of the rotatable cleaning member 4 in the form of impurities B different from the particles A. The impurities B are sparingly retransferred from the rotatable cleaning member 4 to the applicator roller 3, despite aging.

Figure 5:
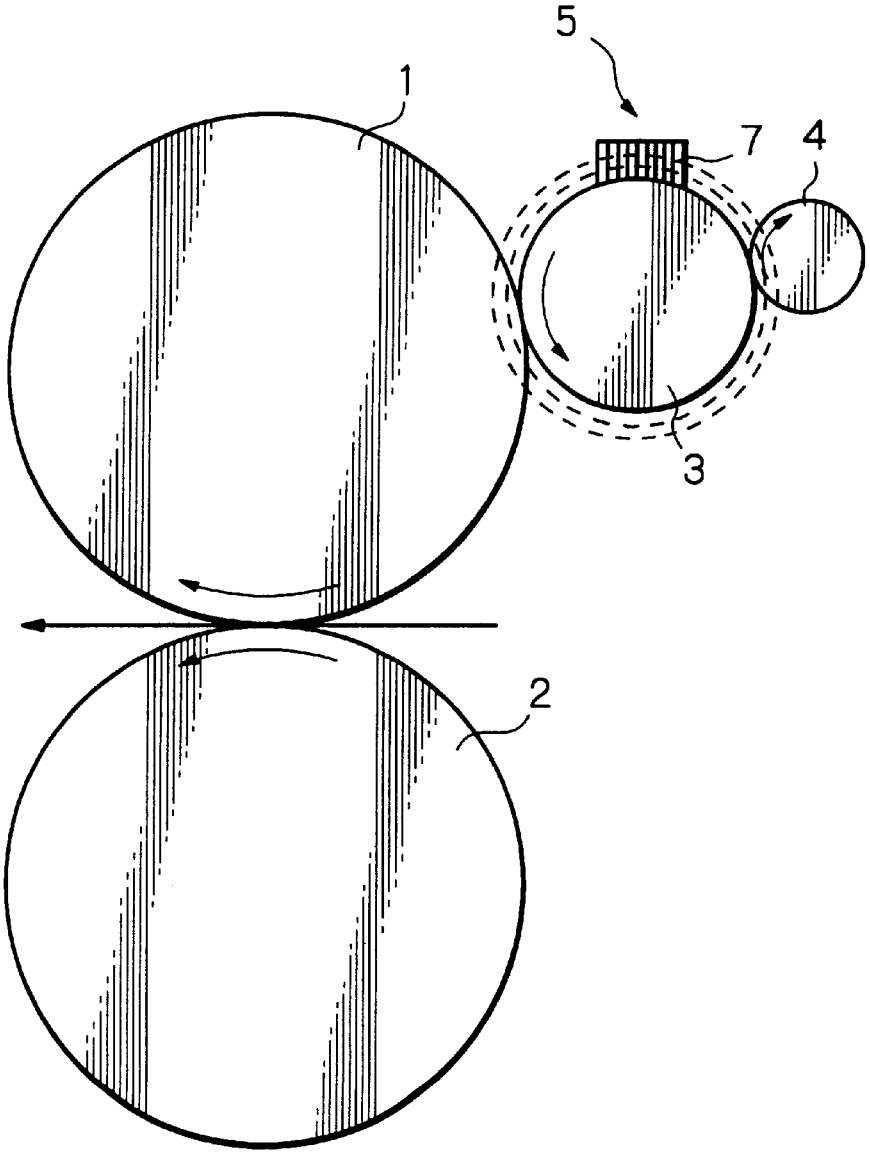
FIG. 5 is a fragmentary front view showing a third embodiment of the fixing device in accordance with the present invention.

FIG. 5 shows a third embodiment of the present invention identical with the first embodiment except for the following. As shown, the stationary cleaning member 5 is shown as a brush 7 in FIGS. 5 and 6. The brush 7 is formed of polyphenylene sulfide or similar heat-resistant resin.

Figure 6:
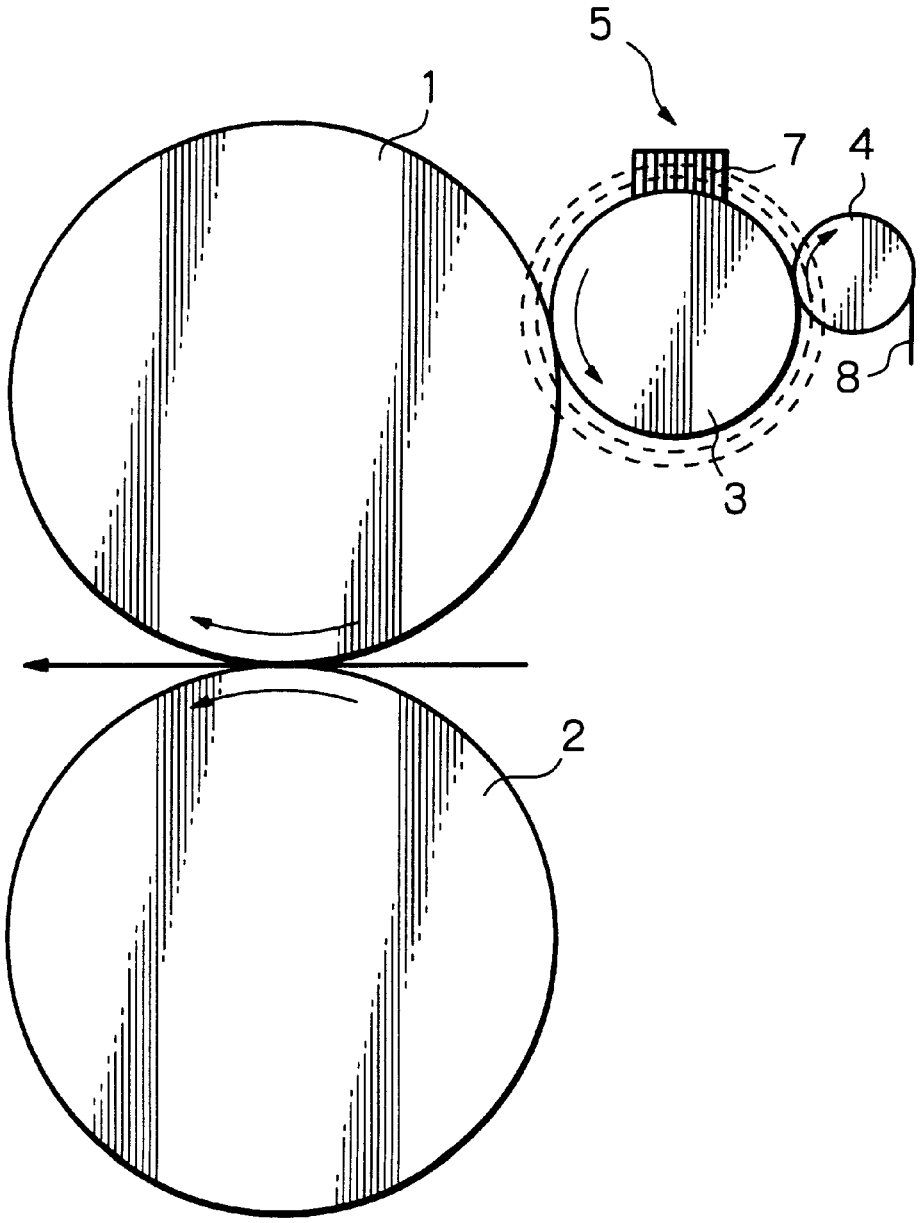
FIG. 6 is a fragmentary front view showing a fourth embodiment of the fixing device in accordance with the present invention.

FIG. 6 shows a fourth embodiment of the present invention identical with the third embodiment except for the following. As shown, an auxiliary stationary cleaning member 8 is held in contact with the rotatable cleaning member 4. The auxiliary cleaning member 8 may take the form of a blade or a brush formed of heat-resistant resin or a blade formed of heat-resistant felt or metal. Between the blade or the brush, the brush, formed of heat-resistant resin, is preferable for the sure collection and holding of impurities and the leveling of oil.

In the third and fourth embodiments, as in the first embodiment, impurities deposited on the heat roller 1 due to offset are transferred to the applicator roller 3. The rotatable cleaning member 4 collects most of the impurities from the applicator roller 3. When the impurities are retransferred from the cleaning member 4 to the applicator roller 3, the stationary cleaning member 5 successfully blocks and collects them. In addition, the stationary cleaning member 5 regulates and levels the oil tending to stay between the applicator roller 3 and the rotatable cleaning member 4.

In the third and fourth embodiments, the stationary cleaning member 5 in the form of the brush 7 sparingly scratches the surface of the applicator roller 3 and can contact it with a low pressure. The brush 7 is therefore readily applicable to various forms of fixing devices only if the configuration of the brush 7, e.g., orientation, density, length and contact area are adequately selected.

In the fourth embodiment, the auxiliary stationary cleaning member 8 is formed of metal and scrapes off the impurities deposited on the rotatable cleaning member 4. The rotatable cleaning member 4 is therefore constantly cleaned and further reduces the retransfer of impurities therefrom to the applicator roller 3.

In summary, it will be seen that the present invention provides a fixing device for an image forming apparatus capable of obviating granular impurities easily retransferred from a rotatable cleaning member to an applicator roller. At the same time, the apparatus is capable of collecting paper dust from the applicator roller. This successfully prevents image quality from being lowered by impurities and prevents the ability of the applicator roller from being lowered. Further, the apparatus frees images from blurring, which is ascribable to oil and the retransfer of the impurities. In addition, the apparatus is capable of collecting the impurities retransferred from the rotatable cleaning member, leveling oil, and protecting the applicator roller from scratches and is therefore usable over a long time.

Various modifications will become possible for those skilled in the art after receiving the teachings of the present disclosure without departing from the scope thereof.

What is claimed is:

1. A fixing device for an image forming apparatus, comprising:

a heat roller;

a press roller pressed against said heat roller;

an applicator roller contacting any one of said heat roller and said press roller for applying oil to said at least one of said heat roller and said press roller, wherein said oil is supplied from a separate oil supply member in oil supplying contact with said applicator roller; and cleaning means comprising a rotatable cleaning member and a stationary cleaning member, wherein both said stationary cleaning member and said rotatable cleaning member are held in contact with said applicator roller.

2. The fixing device as claimed in claim 1, wherein said stationary cleaning member contacts said applicator roller at a position upstream of a position where said heat roller and said applicator roller contact each other, but downstream of a position where said applicator roller and said rotatable cleaning member contact each other.

3. The fixing device as claimed in claim 2, wherein said stationary cleaning member comprises a brush formed of heat-resistant resin.

4. The fixing device as claimed in claim 2, wherein said stationary cleaning member comprises a blade formed of any one of heat-resistant felt and metal.

5. The fixing device as claimed in claim 2, wherein said rotatable cleaning member is a roller.

6. The fixing device as claimed in claim 1, wherein said stationary cleaning member contacts said applicator roller at a position downstream of a position where said heat roller and said applicator roller contact each other, but upstream of a position where said applicator roller and said rotatable cleaning member contact each other.

7. The fixing device as claimed in claim 1, wherein said stationary cleaning member comprises a brush formed of heat-resistant resin.

8. The fixing device as claimed in claim 1, wherein said rotatable cleaning member can collect impurities from said applicator roller.

9. The fixing device as claimed in claim 8, wherein said stationary cleaning member both blocks and collects said impurities re-transferred from said rotatable cleaning member to said applicator roller.

10. The fixing device as claimed in claim 1, wherein said stationary cleaning member comprises a blade formed of any one of heat-resistant felt and metal.

11. The fixing device as claimed in claim 1, wherein said rotatable cleaning member is a roller.

12. The fixing device as claimed in claim 1, further comprising an auxiliary stationary cleaning member which is held in contact with said rotatable cleaning member for scraping off impurities deposited on said rotatable cleaning member.

13. The fixing device as claimed in claim 12, wherein said auxiliary cleaning member is any one of a blade, formed of any one of heat-resistant felt and metal, and a brush, formed of a heat-resistant resin.

14. A fixing device for an image forming apparatus, comprising:

a heat roller;

a press roller pressed against said heat roller;

first and second applicator rollers, wherein said first applicator roller is in contact with said heat roller for applying oil to said heat roller and wherein said second applicator roller is in contact with said press roller for applying oil to said press roller, wherein said oil is supplied from a separate oil supply member in oil supplying contact with each of said first and second applicator rollers; and cleaning means comprising a rotatable cleaning member and a stationary cleaning member, wherein both said stationary cleaning member and said rotatable cleaning member are held in contact with said applicator rollers.

* * * * *